US012312732B2

(12) United States Patent
Lee et al.

(10) Patent No.: US 12,312,732 B2
(45) Date of Patent: May 27, 2025

(54) LAUNDRY TREATING APPARATUS

(71) Applicant: LG ELECTRONICS INC., Seoul (KR)

(72) Inventors: Jihong Lee, Seoul (KR); Minkyu Sang, Seoul (KR); Jihun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 253 days.

(21) Appl. No.: 17/925,935

(22) PCT Filed: May 18, 2021

(86) PCT No.: PCT/KR2021/006201

§ 371 (c)(1),
(2) Date: Nov. 17, 2022

(87) PCT Pub. No.: WO2021/235821

PCT Pub. Date: Nov. 25, 2021

(65) Prior Publication Data

US 2023/0183913 A1 Jun. 15, 2023

(30) Foreign Application Priority Data

May 18, 2020 (KR) ..... 10-2020-0059026

(51) Int. Cl.
*D06F 29/00* (2006.01)
*D06F 37/04* (2006.01)
*D06F 39/12* (2006.01)

(52) U.S. Cl.
CPC ..... *D06F 39/125* (2013.01); *D06F 29/00* (2013.01); *D06F 37/04* (2013.01)

(58) Field of Classification Search
CPC ..... D06F 29/00; D06F 29/005; D06F 39/12; D06F 39/125; D06F 37/20; D06F 37/26
See application file for complete search history.

(56) References Cited

U.S. PATENT DOCUMENTS

2005/0172678 A1* 8/2005 Kim ..... D06F 39/125 68/3 R
2009/0057527 A1 3/2009 Jo
(Continued)

FOREIGN PATENT DOCUMENTS

KR 10-2006-0031297 A 4/2006
KR 10-2010-0129717 A 12/2010
(Continued)

OTHER PUBLICATIONS

Machine Translation of KR-101637346-B1, Jul. 2016. (Year: 2016).*

*Primary Examiner* — David G Cormier
(74) *Attorney, Agent, or Firm* — Birch, Stewart, Kolasch & Birch, LLP

(57) ABSTRACT

A laundry treating apparatus includes: a first cabinet; a first accommodating part provided inside the first cabinet to accommodate clothes; a second cabinet provided under the first cabinet; a second accommodating part provided inside the second cabinet to accommodate clothes; a plurality of support parts extending from a lower portion of the first cabinet to support a load of the first cabinet; and a plurality of brackets provided on the second cabinet to support the plurality of support parts. The plurality of brackets includes: a support plate in contact with an upper portion of the second cabinet to support the first cabinet; and a rib protruding upward from at least a portion of an outer circumferential surface of the support plate.

20 Claims, 5 Drawing Sheets

(56) References Cited

U.S. PATENT DOCUMENTS

| | | | | |
|---|---|---|---|---|
| 2010/0018259 | A1* | 1/2010 | Jeong | D06F 31/00 68/17 R |
| 2010/0201236 | A1* | 8/2010 | Kim | D06F 39/125 312/228 |
| 2018/0195224 | A1 | 7/2018 | Heo et al. | |

FOREIGN PATENT DOCUMENTS

| | | | |
|---|---|---|---|
| KR | 10-1637346 | B1 | 7/2016 |
| KR | 10-2017-0002879 | A | 1/2017 |

* cited by examiner

LAUNDRY TREATING APPARATUS

CROSS REFERENCE TO RELATED APPLICATIONS

This application is the National Phase of PCT International Application No. PCT/KR2021/006201, filed on May 18, 2021, which claims priority under 35 U.S.C. 119(a) to Patent Application No. 10-2020-0059026, filed in the Republic of Korea on May 18, 2020, all of which are hereby expressly incorporated by reference into the present application.

BACKGROUND

Field of the Invention

The present disclosure relates to a laundry treating apparatus.

Related Art

In general, a laundry treating apparatus refers to an apparatus capable of washing and drying clothing or the like, or washing or drying clothing. The laundry treating apparatus may perform only a washing or drying function, or may perform both washing and drying functions. In addition, in recent years, a washing machine equipped with a steam supply device having a refresh function such as removing wrinkles, odors, and static electricity from clothing has been widely used.

Recently, in addition to a main laundry treating apparatus installed to wash or dry general clothing, an auxiliary laundry treating apparatus to treat clothing such as underwear and baby clothes, which are small in amount but need to be frequently washed or dried, has been introduced.

The auxiliary laundry treating apparatus is provided so as to be stacked above or below the main laundry treating apparatus, so that a user can select the auxiliary laundry treating apparatus and the main laundry treating apparatus as needed.

FIG. 1 is a view showing a conventional laundry treating apparatus in which an auxiliary laundry treating apparatus is stacked together with a main laundry treating apparatus. Refer to Korean Patent Application Publication No. 10-2019-0012942.

Referring to FIG. 1, the conventional laundry treating apparatus may include a main laundry treating apparatus 10 capable of performing a large-capacity washing or drying operation, and an auxiliary laundry treating apparatus 20 provided below the main laundry treating apparatus to support the main laundry treating apparatus.

The main laundry treating apparatus may be of a front-load type, and the auxiliary laundry treating apparatus may be of a top-load type and a drawer type.

Since a main cabinet 11 of the main laundry treating apparatus 10 may be provided separately from the auxiliary laundry treating apparatus 20, the main cabinet 11 may include a seating leg 31 capable of supporting the main cabinet 11 separately. In addition, a support guide 32 for accommodating the seating leg 31 is included in an upper surface of the auxiliary laundry treating apparatus 20.

Due to bending, in the conventional laundry treating apparatus, the main laundry treating apparatus 10 may be seated on the auxiliary laundry treating apparatus 20 by the seating leg 31 and the support guide 32.

Meanwhile, the support guide 32 is preferably made of a material advantageous in molding, manufacturing, and processing, and is generally made of a plastic or resin type.

However, since the main laundry treating apparatus 10 is of a relatively larger volume and weight than that of the auxiliary laundry treating apparatus 20, a vibration greater than that generated by the auxiliary laundry treating apparatus 20 may occur.

In addition, when the main laundry treating apparatus 10 is of a front-load type, a load is not evenly distributed to an upper surface of an auxiliary cabinet 21 of the auxiliary laundry treating apparatus 20 because a driving part is disposed at a rear side.

Therefore, given that vibrations of complex directions and complex frequencies occur in the main laundry treating apparatus 10, there is a problem that the support guide 32 not provided in a structure with improved durability to address the vibrations. Since the support guide 32 cannot dissipate a vibration itself transmitted from at least one of the auxiliary laundry treating apparatus 20 and the main laundry treating apparatus 10, there is a problem that the support guide 32 has to withstand the entire vibration energy.

In addition, since the support guide 32 is made of plastic or resin, there is a problem that the support guide 32 cannot withstand the vibration transmitted from at least one of the auxiliary laundry treating apparatus 20 and the main laundry treating apparatus 10.

SUMMARY

An aspect of the present disclosure provides a laundry treating apparatus to which a bracket capable of dissipating a vibration transmitted from another treatment apparatus positioned above or a vibration transmitted from itself to a certain level is applied.

Another aspect of the present disclosure provides a laundry treating apparatus having a structure capable of ensuring durability despite transmitted vibrations, the apparatus to which a bracket capable of supporting another treatment apparatus positioned above is applied.

Yet another object of the present disclosure provides a laundry treating apparatus capable of improving durability by manufacturing a metal-based bracket supporting another laundry treating apparatus positioned thereon.

In an aspect of the present disclosure, a laundry treating apparatus includes a first cabinet, a second cabinet, a plurality of support parts, and a plurality of brackets.

A first accommodating part accommodating clothes is provided inside the first cabinet, and a second accommodating part accommodating clothes is provided inside the second cabinet.

The first cabinet includes a plurality of support parts extending from a lower portion of the first cabinet to support a load of the first cabinet.

The second cabinet is located below the first cabinet, and the plurality of brackets is provided above the second cabinet to support the plurality of support units.

In the laundry treating apparatus, the bracket may have a structure capable of dissipating the transmitted vibration by itself.

The bracket may include a support plate and ribs. The support plate may be in contact with an upper portion of the second cabinet to support the first cabinet or the support part.

The rib may protrude upward from at least a portion of an outer circumferential surface of the support plate. The rib may be provided to be bent upwardly from at least a portion of an outer circumferential surface of the support plate.

The rib may include a first rib and a second rib.

The first rib may protrude upward from the support plate along a first edge of the upper surface of the second cabinet. The first rib may be bent to one side of the support plate. The second rib may protrude upward from the support plate along a second edge of the upper surface of the second cabinet. The second rib may be bent to one side from the support plate along the second edge adjacent to the first edge.

The rib may include a third rib. The third rib may be spaced apart from the first rib and the second rib, and may protrude upward from a portion of an outer circumferential surface of the support plate. The third rib may be formed by bending upwardly from a portion of an outer circumferential surface of the support plate.

At least one of the first rib and the second rib may include one or more through-holes. The self-rigidity of the first rib or the second rib may be reinforced by the plurality of through-holes.

The bracket may include ribs capable of dissipating the vibration transmitted from the outside while vibrating by itself like a cantilever lever. The rib may dissipate the vibration transmitted to the bracket as thermal energy, and may be provided to reinforce the rigidity of the bracket itself.

Therefore, due to the ribs, even if the bracket itself is thinly provided, it is possible to support the support part (support leg) of the laundry treating apparatus without unreasonable vibration caused by the laundry treating apparatus.

The ribs may be provided on the entire outer circumferential surface of the bracket, and may be provided to extend only on a portion of the outer circumferential surface of the bracket. At this time, since the outer circumferential surface of the bracket generally corresponds to the outer surface of the cabinet, the vibration can be transmitted with the greatest amplitude. Accordingly, the rib may be disposed to extend to the outer surface of the bracket (one surface facing the outer surface of the cabinet).

In addition, the bracket may be provided in a shape that can secure sufficient vibration resistance or durability even in transmitted vibration.

The bracket may include a ridge protruding from the inner surface of the support plate to one side.

The ridge may protrude by extending in a direction in which the third rib extends along an outer circumferential surface of the support plate.

The bracket may include a cutout configured to be recessed in an inner direction of the support plate to separate the first rib and the second rib.

The cutout may be provided in a form that is depressed in an inner direction of the support plate from a vertex where the first edge and the second edge intersect.

The bracket may include a receiving groove provided to support any one of the plurality of support parts.

The receiving groove may extend from the cutout and be provided in a shape recessed in the inner direction of the support plate in the cutout.

The receiving groove may be provided to receive any one of the plurality of support parts through the support plate.

The receiving groove may include a rim protruding upward from the support plate to support the side surfaces of the plurality of support parts.

The rim may be bent upwardly from the support plate.

The bracket may have one or more bead shapes protruding convexly or concavely from the surface.

The beads may be provided along the edge of the bracket, and may be provided in plurality to be spaced apart.

In addition, the beads may be provided to extend inside the bracket along the shape of the bracket.

The second cabinet may include a main body and a frame supporting the main body in front and rear of the main body.

The plurality of brackets may be coupled to the frame.

The frame may include a pull-out frame and a fixed frame.

The pull-out frame may be disposed in front of the main body to support the main body. The fixing frame may be disposed behind the main body to support the main body.

The plurality of brackets may be combined with the pull-out frame or the fixed frame.

At least one of the plurality of brackets may be of a metal material. At least one of the plurality of brackets may be of the same material as that of the second cabinet.

Among the plurality of brackets supporting the upper laundry treating apparatus, a bracket at a position vulnerable to vibration may be of a metal material. The entire bracket may be of a metal material.

The first cabinet may further include a driving part configured to rotate the first accommodating part therein. The driving part may be provided at a rear of the first cabinet in the first cabinet.

The plurality of brackets may be provided at the front and rear of the upper part of the second cabinet, and among the plurality of brackets, the bracket provided at the front of the upper part of the second cabinet may be of a metal material.

Among the plurality of brackets, a bracket provided at the rear of the upper portion of the second cabinet may be of a metal material.

The plurality of brackets may be provided at each corner of the upper portion of the second cabinet.

According to one aspect of the present disclosure, the receiving unit receiving unit The laundry treating apparatus includes a first cabinet, a second cabinet, a plurality of supports, and a plurality of brackets.

At least one of the plurality of brackets may be of a metal material.

At least two of the plurality of brackets is of the same material as the second cabinet so as to maintain coupling force with the second cabinet or to disperse the vibration even in the case of vibrations generated in the first cabinet or the second cabinet. Or, it may be provided with a metal material.

It may further include a loading port provided at the front of the first cabinet to put clothing into the first accommodating part, and a driving part provided on the rear surface of the first accommodating part to rotate the first accommodating part.

The plurality of brackets may be provided at each vertex of the second cabinet, and among the plurality of brackets, the bracket provided in front of the second cabinet may be of a metal material.

The plurality of brackets may be provided at each vertex of the second cabinet, and among the plurality of brackets, the bracket provided in front of the second cabinet may be of the same material as the second cabinet or made of a metal material.

The plurality of brackets may be provided at each vertex of the second cabinet, and among the plurality of brackets, the bracket provided at the rear of the second cabinet may be of the same material as the second cabinet or made of a metal material.

The plurality of brackets may be provided at each vertex of the second cabinet, and the brackets disposed in a diagonal direction among the plurality of brackets may be of the same material as the second cabinet or made of a metal material.

The bracket includes a support plate in contact with an upper portion of the second cabinet to support the first cabinet, and a rib bent on at least a portion of an outer circumferential surface of the support plate to reinforce rigidity of the support plate or to dissipate vibration transmitted to the support plate.

The support plate may include a first extension extending along a first edge of the second cabinet, and a second extension extending along a second edge adjacent to the first edge in the first extension.

The rib may include a first rib bent on the exposed surface of the first extension and a second rib bent on the exposed surface of the second extension.

The bracket may further include a cutout recessed inside the support plate to separate the first rib and the second rib.

The rib may further include a third rib extending upwards and extending the inner surface of the first extension and the inner surface of the second extension.

The bracket may include a ridge protruding from the inside of the support plate along the third rib to reinforce rigidity of the support plate or to dissipate vibration transmitted to the support plate.

The bracket may further include a receiving groove provided to support any one of the plurality of support parts (support legs).

The receiving groove may be provided to extend from the cutout so as to have a larger diameter than the cutout to support any one of the plurality of support parts (support legs).

The receiving groove may be provided to receive any one of the plurality of support parts (support legs) through the support plate spaced apart from the cutout.

According to an aspect of the present disclosure, the support plate may further include a cutout for separating the exposed surface of the first extension and the exposed surface of the second extension.

The cutout may be provided in a form that is depressed in an inner direction of the support plate from a vertex where the first edge and the second edge intersect.

The rib includes a first curved rib that is curved on a part of the exposed surface of the first extension and is provided to be spaced apart from the cutout, and a first curved rib that is bent on a part of the exposed surface of the second extension and is provided to be spaced apart from the cutout. It may include two curved ribs.

The bracket may include an incision protruding from the outer circumferential surface of the cutout and provided to be spaced apart from the first curved rib and the second curved rib.

The bracket may further include a receiving groove which is provided extending from the cutout to support any one of the plurality of support parts (support legs). The receiving groove may be provided to have a larger diameter than the cutout.

There may be further included a receiving projection provided to protrude along an outer circumferential surface of the receiving groove and provided to be spaced apart from the first and second curved ribs.

The bracket may further include a ridge provided to protrude along the inner surface of the support plate.

At least two or more of the incision jaw, the receiving projection, and the ridge may be integrally provided with each other.

The receiving groove may be provided to receive any one of the plurality of support parts (support legs) through the support plate spaced apart from the cutout.

The bracket may further include a protruding ring that protrudes along an outer circumferential surface of the receiving groove and is spaced apart from the first and second curved ribs.

The cutout jaw and the protruding ring may be provided integrally with each other.

The bracket may further include one or more through-holes penetrating at least one of the first curved rib and the second curved rib.

According to at least one of the embodiments of the present disclosure, a bracket itself may be able to dissipate a vibration transmitted from an upper laundry treating apparatus or a vibration transmitted from itself to a certain level.

According to at least one of the embodiments of the present disclosure, it is possible to provide a bracket having sufficient durability despite a large vibration that a general plastic or resin-based bracket cannot withstand.

According to at least one of the embodiments of the present disclosure, it is possible to improve durability by providing a metal-based bracket for supporting another laundry treating apparatus positioned above.

DESCRIPTION OF EXEMPLARY EMBODIMENTS

Figure 1:
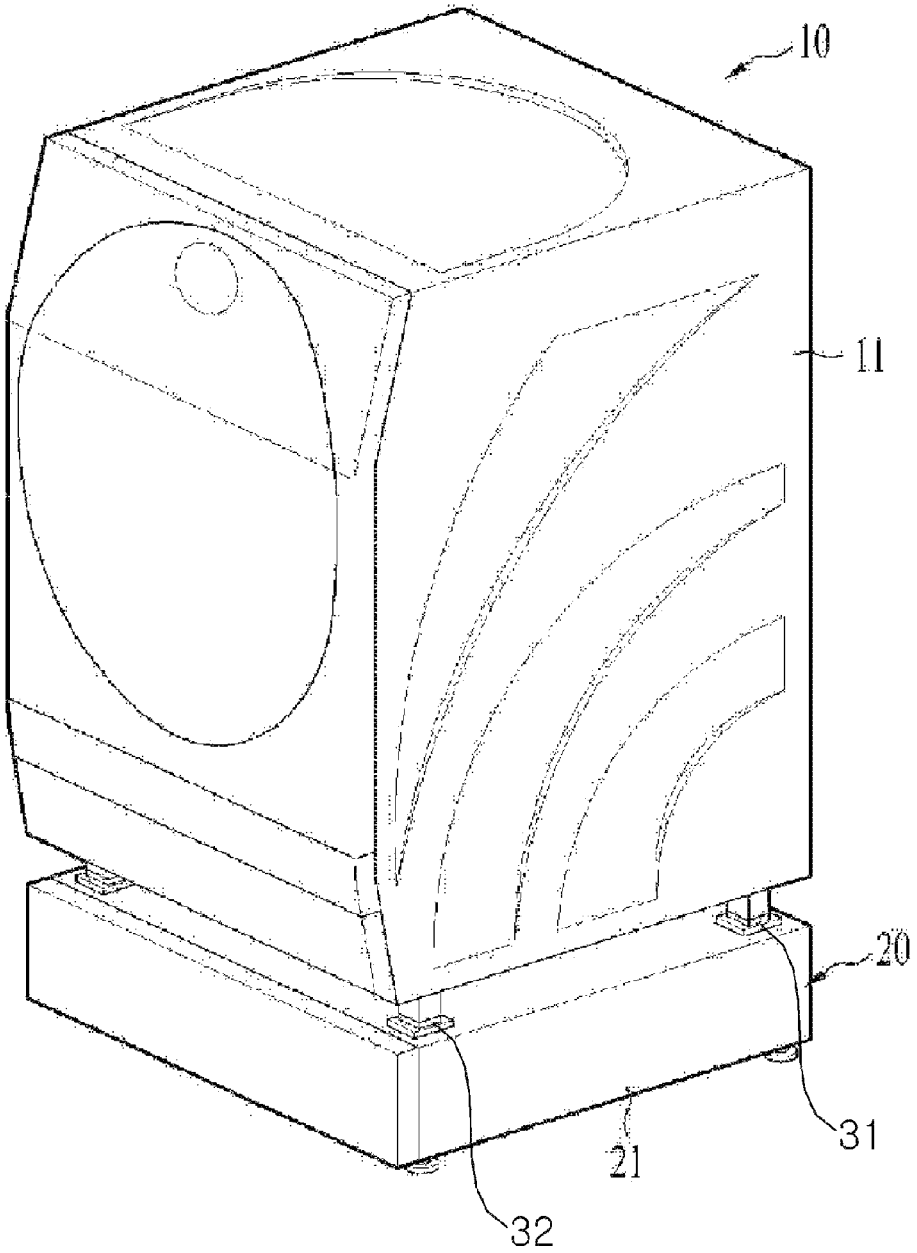
FIG. 1 shows a structure of a conventional laundry treating apparatus.

Hereinafter, embodiments disclosed herein will be described in detail with reference to the accompanying drawings, and regardless of the reference numerals, the same or similar components are assigned the same reference numerals, and overlapping descriptions thereof will be omitted.

In the following description, a suffix such as "module" and "unit" may be used to refer to elements or components, and the use of such a suffix herein is merely intended to facilitate description of the specification, and the suffix itself is not intended to give any special meaning or function.

In addition, in the following description of the embodiments, a detailed description of known functions and configurations incorporated herein will be omitted when it may impede the understanding of the embodiments. In addition, the accompanying drawings are used to help easily understand various technical features and it should be understood that the embodiments presented herein are not limited by the accompanying drawings, and, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present.

As used herein, the singular forms "a", "an," and "the" are intended to include the plural forms as well, unless the context clearly indicates otherwise.

Furthermore, although each drawing is described for convenience of description, implementing another embodiment by those skilled in art by combining at least two or more drawings also falls within the scope of the present disclosure.

Figure 2:
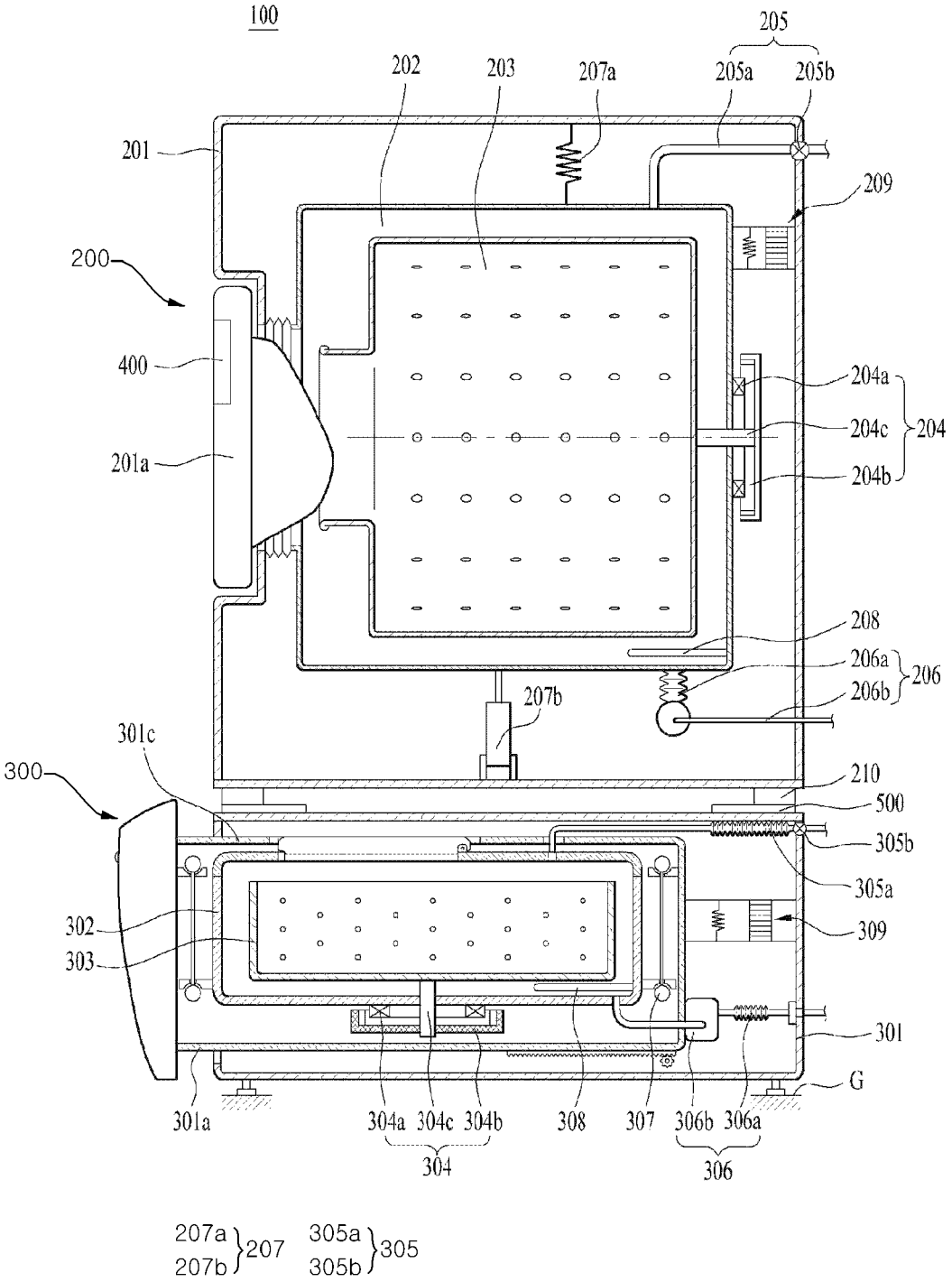
FIG. 2 shows a structure of a laundry treating apparatus according to an embodiment of the present disclosure.

FIG. 2 shows a basic structure of a laundry treating apparatus according to an embodiment of the present disclosure.

A laundry treating apparatus 100 according to an embodiment of the present disclosure may include a first treatment unit 200, which is a main laundry treating apparatus, and a second treatment unit 300, which is an auxiliary laundry treating apparatus.

The first treatment unit 200 may be provided as a washing apparatus for performing a washing cycle to remove foreign substances from clothes, and may be provided as a drying apparatus for performing a drying cycle to dry clothes with moisture contained therein.

When the first treatment unit 200 is provided as a washing machine, the first treatment unit 200 may also perform the drying cycle to dry clothes.

The second treatment unit 300 may be provided as a washing apparatus for performing a washing cycle to remove foreign substances from clothes, and may be provided as a drying apparatus for performing a drying cycle to drying clothes with moisture contain therein.

When the second treatment unit 300 is provided as a washing machine, the second treatment unit 300 may also perform the drying cycle to dry clothes.

The first treatment unit 200 may be provided in a larger size than that of the second treatment unit 200 so as to have a larger washing or drying capacity than that of the second treatment unit 300.

This is to enable the second treatment unit 300 to quickly wash or dry underwear, baby clothes, and a small amount of clothes while saving energy.

The second treatment unit 300 may be provided in combination with the first treatment unit 200.

In this case, even if the first treatment unit 200 and the second treatment unit 300 are separated, one display part 400 may be provided so as to display the states of the first treatment unit 200 and the second treatment unit 300, and to receive an operation command to control the first treatment unit 200 and the second treatment part 300 to perform at least one of a washing cycle or a drying cycle.

The second treatment unit 300 may be provided separately from the first treatment unit 200, and the second treatment unit 300 may be coupled to the first treatment unit 200 to form one laundry treating apparatus.

When the second treatment unit 300 is provided separately from the first treatment unit 200, the first treatment unit 200 may include a first cabinet 201 forming an exterior and the second treatment unit 300 may include a second cabinet 301 forming an exterior and provided separately from the first cabinet 201.

The second treatment unit 300 may be provided under the first treatment unit 200. The first treatment unit 200 may be provided as a front-load type laundry treating apparatus, and the second treatment unit 300 may be provided as a top-load type laundry treating apparatus. The second treatment unit 300 may be provided of a drawer type in order to avoid interference with the front-load type laundry treating apparatus. The second treatment unit 300 may include a drawer 301*a* to be withdrawn forward from the second cabinet 301, and a second accommodating part 302 and 303 for accommodating clothes in the drawer 301*a*.

Meanwhile, since the first treatment unit 200 is seated on the second treatment unit 300, a plurality of support parts (support legs) 210 to be seated on a second cabinet 301 of the second treatment unit 300 may be provided under the first cabinet 201 of the first treatment unit 200.

Meanwhile, in order to prevent an overturn when the drawer 301*a* is withdrawn, the second treatment unit 300 may be provided to operate only when the first treatment unit 200 is seated thereon.

When the first treatment unit 200 and the second treatment unit 300 are provided as a washing machine, the first treatment unit 200 may include a first accommodating part 202 and 203 provided inside the cabinet 201 to accommodate clothes.

The first accommodating parts 202 and 203 may include a first tub 202 for storing water, and a first drum 203 rotatably provided in the first tub 202 to accommodate clothes. The first drum 203 may be provided with a loading port provided at a front to load clothes.

The first treatment unit 200 may include a first driving part 204 provided on one surface of the first tub 202 to rotate the first drum 203, a first water supply part 205 for supplying water to the first tub 202, and a first drain part 206 for draining water from the first tub 202.

The first driving part 204 may be attached to a rear surface of the first tub 202.

The first driving part 204 may include a first stator 204*a* forming a rotating magnetic field, a first rotor 204*b* provided to be rotatable by the rotating magnetic field, and a rotational shaft 204*c* connecting the rotor and one surface of the drum.

In addition, it is also possible for the first driving part 204 to include a motor provided on one side of the first tub 202, a rotational shaft connecting one surface of the drum and protruding from a rear surface of the tub, a pulley provided in the rotational shaft and the motor, and a belt connecting the pulley.

The first water supply part 205 may include a first water supply pipe 205*a* connecting an external water supply source and the first tub 202, and a first water supply valve 205*b* for regulating a flow rate of the first water supply pipe 205*a*.

In addition, the first drain part 206 may include a first drain pipe 206*b* extending from the first tub 202 to an outside of the cabinet 201, and a first drain pump 206*a* providing power to drain water from the first tub 202 and communicating with the first drain pipe 206*b*.

The second treatment unit 300 may include a second accommodating part 302 and 303 provided inside the second cabinet 301 and provided under the first treatment unit 200. The second accommodating part 302 may include a second tub 302 accommodating water, and a second drum 303 rotatably provided in the second tub 302 and accommodating clothes.

The second treatment unit 300 may include a second driving part 304 provided on one surface of the second tub 302 to rotate the second drum 303, a second water supply part 305 for supplying water to the second tub 302, and a second drain part 306 for draining water from the second tub 302.

The second driving part 304 may be coupled to a bottom surface of the second tub 302.

Meanwhile, the first treatment unit 200 may include a first suspension 207 supporting the first tub 202 in the cabinet 201, and the second treatment unit 300 may include a second suspension 307 supporting the second tub 302 in the second cabinet 301.

The first suspension 207 and the second suspension 307 may be provided as a combination of a spring 207*a* and a damper 207*b*, and may be provided as a combination of a bracket and a connecting bar.

The first suspension 207 and the second suspension 307 may have any shape as long as they can support the first tub 202 and the second tub 302.

When the second treatment unit 300 is provided of a drawer type, a drawer 301*a* to be withdrawn from the second cabinet 301 may be provided, and the second tub 302 and the second drum 303 may be provided inside the drawer 301*a*.

The second driving part 304 includes a second stator 304*a* forming a rotating magnetic field, a second rotor 304*b* provided to be rotatable by the rotating magnetic field, and a second rotational shaft 304*c* connecting the rotor and one surface of the drum.

In addition, it may also be possible for the second driving part 304 to include a motor spaced apart from the second tub 302, a rotational shaft connecting one surface of the drum and protruding from a rear surface of the tub, a pulley provided in the rotational shaft and the motor, and a belt connecting the pulley.

The second water supply part 305 may include a second water supply pipe 305*a* connecting an external water supply source and the second tub 302, and a second water supply valve 305*b* for regulating a flow rate of the second water supply pipe 305*a*.

In addition, the second drain part 306 may include a second drain pipe 306*a* extending from the second tub 302 to an outside of the second cabinet 301, and a second drain pump 306*b* providing power to drain water from the second tub 302 and communicating with the second drain pipe 306*a*.

The first treatment unit 200 may further include a first heater 208 for heating water to the first tub 202 and a first hot air supply part 209 for supplying hot air to the first tub 202.

The first heater 208 is preferably provided under the first tub 202, and a sheath heater may be applied.

Of course, the first heater 208 may have any shape as long as it can heat water in the first tub 202. The first hot air supply part 209 may include a duct for supplying air to the first tub 201, a duct heater provided inside the duct, and a fan for supplying air from the duct to the first tub 202.

The second treatment unit 300 may also include a heater 308 and a hot air supply part 309, as does the first treatment unit 200.

Meanwhile, the first treatment unit 200 and the second treatment unit 300 may include a power supply for supplying power to the first treatment unit 200 and the second treatment unit 300. The power supply may include a switch provided in the first cabinet 201 or the second cabinet 301. The switch may be provided on one side of the display unit 400.

Meanwhile, at least one of the first treatment unit 200 and the second treatment unit 300 may be provided as a drying apparatus. A treatment unit provided as a drying apparatus out of the first treatment unit 200 and the second treatment unit 300 may have all of the above-described configurations of the water supply part, the drainage unit, the tub, and the heater omitted therein.

Meanwhile, even if the first treatment unit 200 is disposed on the second treatment unit 300, the first treatment unit 200 may be overturned in the second treatment unit 100 due to the center of gravity being concentrated to one point or due to vibration, etc.

In order to prevent the overturn, it is necessary for the first treatment to be stably seated on the second treatment unit 300 even when disposed thereon. In addition, the first treatment unit 200 needs to be seated at an intended position on the second treatment unit 300.

However, the first treatment unit 200 has a considerable volume, and when the first treatment unit 200 is provided as a main laundry treating apparatus, the volume thereof may be significantly larger than that of the second treatment unit 300.

Thus, it is necessary to induce the first treatment unit 200 to be disposed at a correct position in an upper portion of the second treatment unit 300, and to stably fix the first treatment unit 200 to the second treatment unit 300.

To this end, the laundry treating apparatus according to an embodiment of the present disclosure includes a bracket 500 provided between the second cabinet and the first cabinet to support the first cabinet. When the first cabinet 201 is seated on the second cabinet 301, the bracket 500 may guide the first cabinet 201 to be placed at a correct position on the second cabinet 301.

The support leg 210 may be provided in plural at or near a vertex of a lower surface of the first cabinet 201. This is for the support leg 210 to maintain and stably support the center of gravity of the first cabinet 201.

The bracket 500 may be provided separately from the second cabinet 301, or may be provided integrally with the second cabinet 301.

Figure 3:
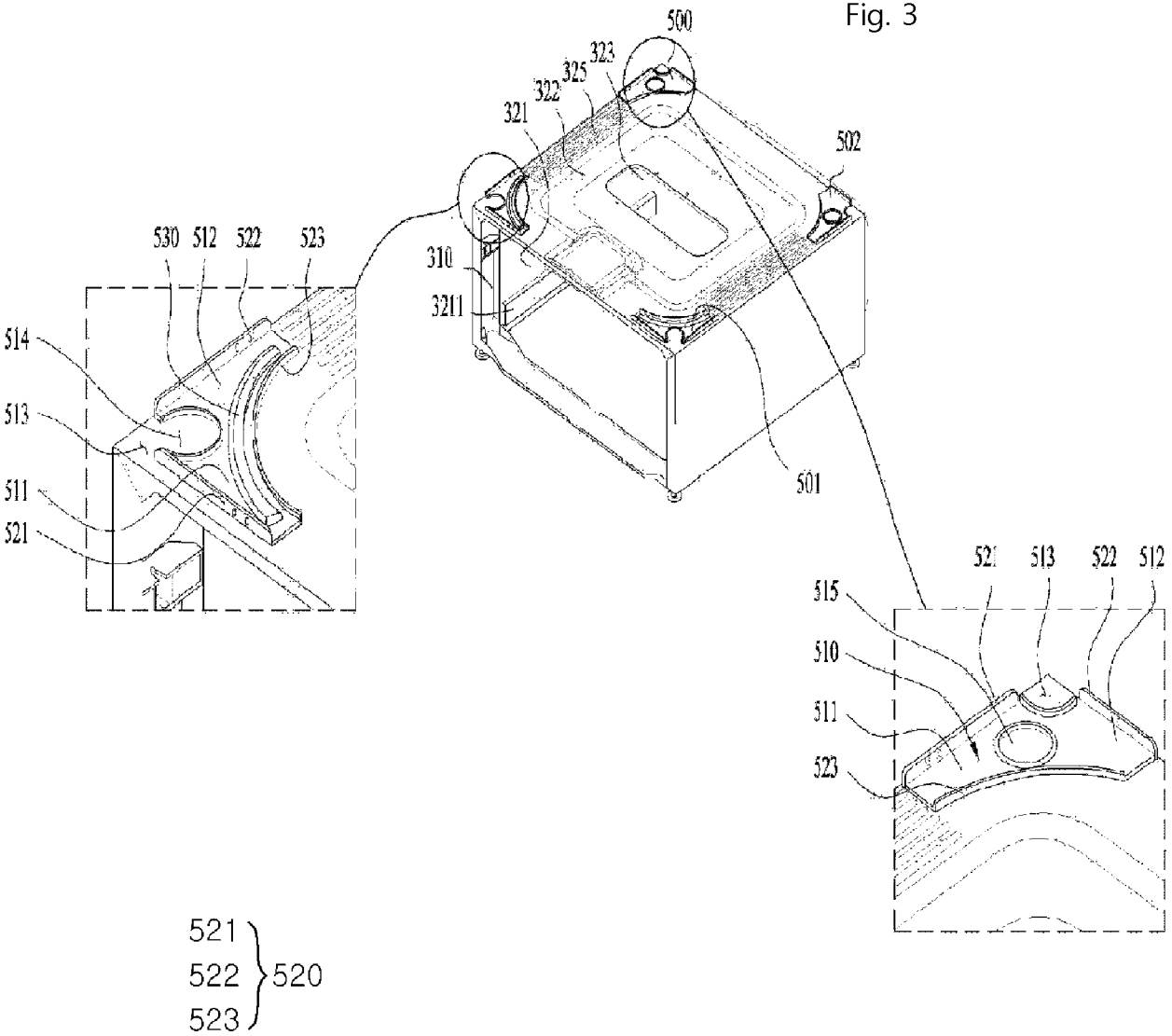
FIG. 3 illustrates a bracket of a laundry treating apparatus according to an embodiment of the present disclosure.

FIG. 3 shows a structure in which a bracket 500 included in a laundry treating apparatus 100 according to an embodiment of the present disclosure is installed in a second cabinet 301.

Figure 4:
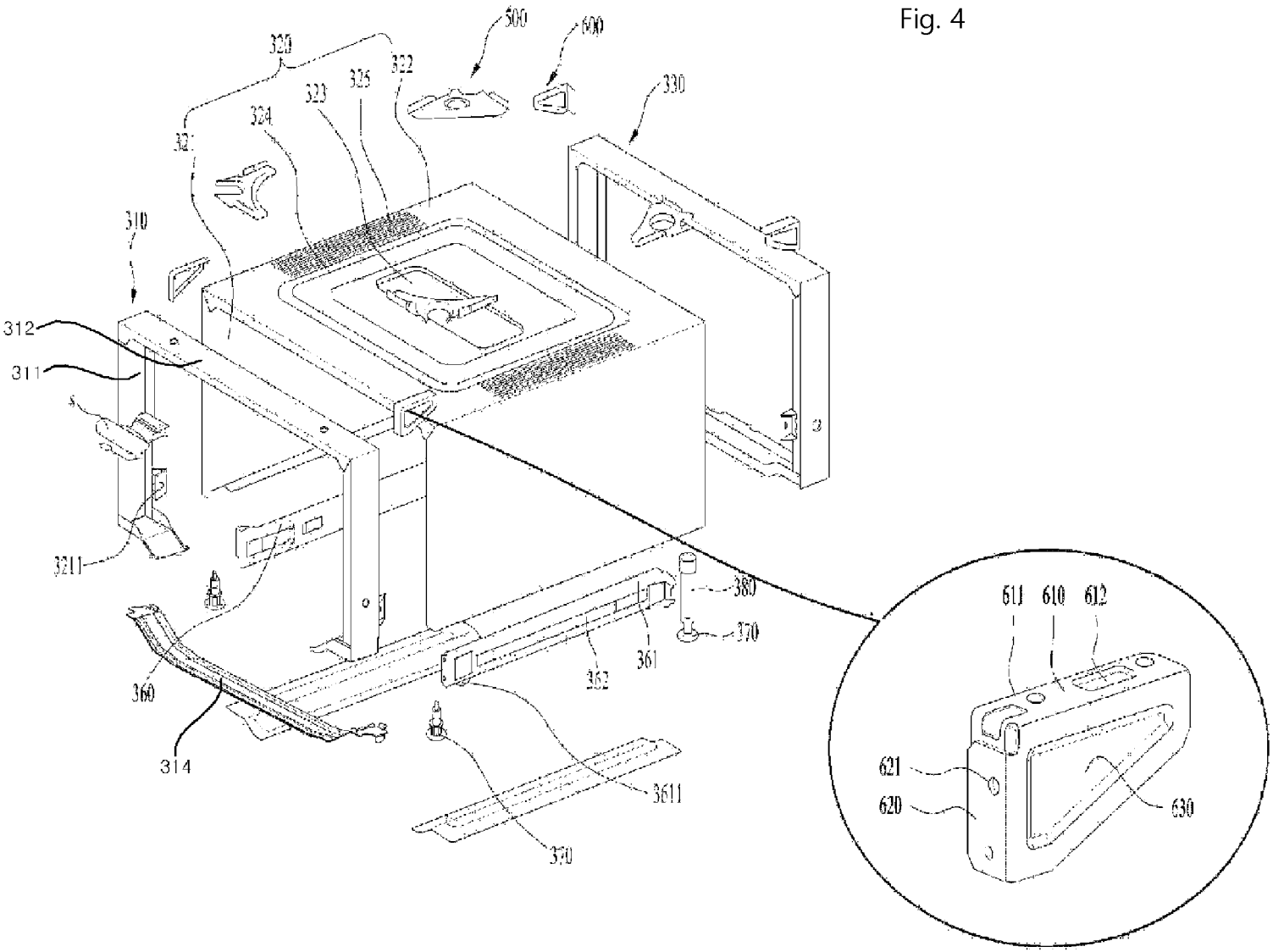
FIG. 4 is a view showing a coupling structure of a bracket and a cabinet of a laundry treating apparatus according to an embodiment of the present disclosure.

Referring to FIGS. 3 and 4, the second cabinet 301 may include a main body 320 accommodating a drawer 301*a*, and a frame disposed at front and rear sides of the main body 320 to support the main body 320.

The frame may include a pull-out frame 310 and a fixed frame 330.

The drawer frame 310 may be disposed at a front side of the main body 320 to form an opening through which the drawer 301*a* is to be pulled in and out.

The main body 320 may include an upper panel 322 disposed below the first treatment unit 200 and forming an upper surface of the second cabinet 301, and a side panel 321 extending downward from both sides of the upper panel 322 and forming a side surface of the second cabinet 301.

The main body 320 may be provided in a case shape, but, for convenience of manufacture, may also be provided in a shape where front, rear, and lower sides are open.

The upper panel 322 may include a support groove 323 into which a separate buffer member for maintaining a distance between the second tub 302 and the drawer 301*a* can be inserted during transportation. The buffer member inserted into the support groove 323 may extend upward of the upper panel 322 to support the first tub 202 located inside the first cabinet 201.

A reinforcement step 324 for reinforcing the rigidity of the upper panel 322 may be provided along an outer circumferential surface of the support groove 323. Even if a lower surface of the upper panel 322 is not supported by a separate member, the upper panel 322 may be maintained in shape due to the reinforcement step 324, without being bent downward.

A recognition blocking part 325 for generating diffuse reflection on surfaces of the both sides of the upper panel 322 may be provided. The recognition blocking part 325 is a space in which a separate buffer member is seated in a case where a plurality of second cabinets 201 is stacked during manufacture or transportation. In this case, as the buffer member is seated for a long time, the surface of the second cabinet 201 may be contaminated or stained. The recognition blocking part 325 may generate diffuse reflection on the surfaces, thereby prevent the contamination or stain from being seen from the outside. In addition, the recognition blocking part 325 may be installed on the upper panel 322, thereby reinforcing the rigidity of the upper panel 322.

A rail coupling portion 3211, to which a rail 360 with the drawer 301*a* to be pulled in and out there along can be coupled or fixed, may be installed in the pull-out frame 310 and the fixed frame 330.

A bracket 500 for supporting the first cabinet 201 may be provided in the second cabinet 301.

The support leg 210 may be provided in plural at a vertex of the lower surface of the first cabinet 201 or an edge adjacent to the vertex. Therefore, in order to support the support leg 210, the bracket 500 may also be installed in an area corresponding to a position where the support leg 201 is installed.

The bracket 500 may be provided on an upper surface of the second cabinet 301, and may be provided at each edge or vertex of the second cabinet 301.

The bracket 500 may accommodate a lower end of the support leg 210, and may determine an installation position of the support leg 210.

The bracket 500 may support the support leg 210 by being fixed in position despite a vibration transmitted from the support leg 210, and may be fixed to the second cabinet 301 so that the installation position of the bracket 500 is not changed even if a vibration is transmitted from the second cabinet 301.

Meanwhile, since a vibration occurring in the first cabinet 201 is concentrated on the support leg 210, the bracket 500 may receive the concentrated vibration energy. Also, when a vibration occurring in the second cabinet 302 is transmitted to the bracket 500, friction or collision may occur between the bracket 500 and the support leg 210. Moreover, when the first cabinet 201 is in larger size or a larger amount of clothes is accommodated therein, a greater vibration may be applied to the bracket 500.

Therefore, when the bracket 500 is made of a plastic-based material, a resin-based material, or a material manufactured by injection molding, there is a risk that the shape of the bracket 500 is changed or damaged due to a vibration. As a result, there is a risk that the installation position of the first cabinet 201 on the second cabinet 301 is changed or that the first cabinet 201 falls from the second cabinet 301.

In addition, since the bracket 500 has a relatively small weight, the bracket 500 may vibrate greatly even in response to a small vibration. Therefore, there is a possibility that the bracket 500 amplifies the vibration and transmits the amplified vibration.

To prevent the above, the laundry treating apparatus 100 according to an embodiment of the present disclosure may include the bracket 500 made of a metal material. Accordingly, as the rigidity or durability of the bracket 500 is further strengthened more than that of a plastic-based material, it is possible to prevent the bracket from being damaged even by a vibration.

In addition, when the bracket 500 is made of a metal material, a weight thereof is heavier than that of a non-metal material, so when a vibration is transmitted, an amplitude of the vibration may be greatly reduced.

Even in response to a vibration occurring in the first cabinet 201 or the second cabinet 301, the bracket 500 made of a metal material may maintain a coupling force with the second cabinet or distribute the transmitted vibration.

The bracket 500 may be of a material identical to that of the second cabinet 301. Accordingly, the bracket 500 may be formed integrally with the second cabinet 301, and may be manufactured simultaneously with the second cabinet 301 when producing and manufacturing the second cabinet 301. In addition, a sense of unity may be formed between the bracket 500 and the second cabinet 301.

The bracket 500 may be of a material having density and rigidity than those of the second cabinet 301. Accordingly, it is possible not just to secure the durability of the bracket 500, but also to reduce an amplitude by increasing the weight of the second cabinet 301 itself.

Meanwhile, in a case where the laundry treating apparatus 100 is provided with a plurality of brackets 500, only a brackets 500 located at a specific area may be of a metal material.

Accordingly, by using both a plastic-based bracket 500 and a metal-based bracket 500, it is possible to ensure both manufacturing convenience and safety.

Specifically, since a first driving part 204 of the first treatment unit 200 is positioned at a rear of the first cabinet 201 in the laundry treating apparatus 100, a greater load may be applied to a front lower portion than a rear lower portion of the first cabinet 201.

Therefore, the front lower portion of the first cabinet 201 may have a relatively small traction with an upper front portion of the second cabinet 301, and even if the same vibration is transmitted, an amplitude may be larger than in a rear lower portion of the second cabinet 301.

In addition, vibrations may frequently occur at the front of the second cabinet 301 in a process where a front panel of the drawer 301*a* repeatedly comes into contact or the drawer 301*a* is pulled in and out.

In consideration of the above, in the laundry treating apparatus 100, a bracket 500 provided at the front of the second cabinet may be of a metal material and a bracket 500 provided at the rear of the second cabinet may be of a non-metal material.

Therefore, even if amplitude of a vibration occurring in the front upper portion of the second cabinet 301 is larger, it is possible to easily support the first cabinet 201 or the second cabinet 301 with a metal bracket 500. In addition, a bracket 500 disposed on a rear upper portion of the second cabinet 301 may be of a plastic-based material, so the bracket 500 may be molded into a complex structure. For example, a structure in which a switch detector for detecting whether the first cabinet 201 is seated or the like can be installed may be manufactured on the bracket 500 disposed at the rear.

Meanwhile, in the laundry treating apparatus 100, a bracket 500 positioned at the rear of the second cabinet 301 may be of a metal material, and a bracket 500 positioned at the front of the second cabinet 301 may be of a non-metal material.

The first driving part 204 is positioned at the rear of the first cabinet 201, and a first water supply part 205 and a first drain part 206 are also positioned at the rear of the first cabinet 201.

Therefore, a greater load may be applied to the rear of the first cabinet 201 than the front of the first cabinet 201, and the traction with the second cabinet 301 may be increased. Accordingly, a vibration occurring when the first driving part 204 is driven or the first drain part 206 is operated may be intensively transmitted to the rear of the first cabinet 201.

The bracket 500 disposed at the rear may be of a metal material to sufficiently support the intensively transmitted vibration, thereby minimizing damage to the bracket 500 disposed at the rear or minimizing an amplitude at which the bracket 500 vibrates on its own. Furthermore, by increasing a self-weight of the rear of the second cabinet 301, it is possible to minimize an amplitude at which the second cabinet 301 vibrates.

The bracket 500 provided at the front of the second cabinet 301 may be of a non-metal material, and may be simply manufactured to reduce a manufacturing cost and may be it is also manufactured with a complexed structure to secure a degree of freedom in which necessary configurations are further installed.

Meanwhile, the laundry treating apparatus 100 may manufacture one set of the brackets 500 located in the diagonal direction of the second cabinet 301 of a metal material, and the other set may be of a non-metal material.

Accordingly, it is possible to reduce a manufacturing cost while effectively supporting vibrations at the front and rear, and to ensure a degree of freedom to manufacture only some configurations when a complex structure is needed.

Meanwhile, the bracket 500 of the laundry treating apparatus 100 may be provided in a shape capable of dissipating a vibration by itself or ensuring durability even in a great vibration. The bracket 500 may be of a metal material, but may not be of a metal material.

The bracket 500 may include a first bracket 501, a second bracket 502, a third bracket 503, and a fourth bracket 504. The first bracket 501, the second bracket 502, the third bracket 503, and the fourth bracket 504 may be different in terms of detailed shapes or installation positions on the second cabinet 201, but may have the same basic principle and structure.

FIG. 3 shows an example in which the first bracket 501 is provided at the front of the second cabinet 301 and the second bracket 502 is provided at the rear of the second cabinet 301, but this is merely exemplary for explanation and the position and number of the bracket 500 may be arbitrarily determined.

The first bracket 501 may include a support plate 510 in contact with the upper portion of the second cabinet 301 to support the first cabinet 201 or the support legs 210, and a rib 520 bent from at least a portion of an outer circumferential surface of the support plate.

The support plate 510 may be provided as a flat steel plate, and may correspond to an edge shape of the second cabinet 301.

Specifically, the support plate 510 may include a first extension 511 extending along a first edge of the second cabinet 301, and a second extension 512 extending along a second edge adjacent to the first edge in the first extension 511. The support plate 510 may be provided in an L-shape.

For example, the first edge may correspond to an upper front edge of the second cabinet 301, and the second edge may correspond to an upper side edge of the second cabinet 301.

The rib 520 may extend from the support plate 510, and may be bent upward from an outside of the support plate 510. The rib 520 may be provided so as to be able to vibrate on the support plate 510 like a cantilever lever. Accordingly, when a vibration is transmitted to the support plate 510, a part of the transmitted vibration energy may be transmitted to the rib 520 and then dissipated as thermal energy.

The rib 520 may be provided at a portion of the support plate 510 exposed to the outside. That is, the rib 520 may extend from respective exposed surfaces of the first extension 511 and the second extension 512, which correspond to or are adjacent to the front surface, the rear surface, or the side surface of the second cabinet 301. Since an amplitude of the vibration transmitted to the second cabinet 301 is further amplified toward the outside of the second cabinet 301, the rib 520 may receive vibration as much as it can be transmitted and dissipate the vibration.

The rib 520 may include a first rib 521 protruding upward from the support plate 510 along a first edge of an upper surface of the second cabinet 301, and a second rib 522 protruding upward from the support plate 510 along a second edge of the upper surface of the second cabinet 301.

The first rib 521 may be provided in a shape to be curved at the exposed surface of the first extension 511, and the second rib 522 may be provided in a shape to be curved at the exposed surface of the second extension 512. The first rib 521 and the second rib 522 may have a predetermined thickness, and may include a plurality of through-holes. Accordingly, the first rib 521 and the second rib 522 may secure their own rigidity above a certain level.

Meanwhile, the first bracket 501 may include a cutout portion 513 recessed from the outside of the support plate 510. The cutout portion 513 may be provided to form a space in which the support leg 210 is seated, and may be provided to avoid a space in which the support leg 210 is seated on the upper surface of the second cabinet 301.

Since the support leg 210 is seated at or near a vertex of the upper surface of the second cabinet 301, the cutout portion 513 may be recessed inward from an outer vertex that is adjacent to the first extension 511 and the second extension 512 in the support plate 510. The cutout portion 513 may be provided in a shape recessed inwardly of the support plate 510 from a vertex where the first edge and the second edge intersect.

The cutout portion 513 may be recessed inwardly of the support plate 510 to separate the first rib 521 and the second rib 522. Thus, the rib 520 may be provided in a straight plate shape without being curved or bent due to the cutout portion 513. Thus, the first rib 521 and the second rib 522 may vibrate freely.

The first rib 521 and the second rib 522 may not be connected to each other, but may be arranged in parallel along an edge of the second cabinet 301.

Thus, the first rib 521 may dissipate vibration transmitted in a direction of the first edge, and the second rib 522 may dissipate vibration transmitted in a direction of the second edge.

In addition, the support plate 510 may increase its own rigidity only by when the first rib 521 and the second rib 522 being bent and extending.

Meanwhile, the support plate 510 may further include a receiving groove 514 and 515 provided to support any one of the plurality of support legs 210.

The receiving groove 514 and 515 may include a first receiving groove 514 or a second receiving groove 515.

The first receiving groove 514 may be provided by being recessed inward of the first extension 511 or the second extension 512 from the cutout part 513, and may be provided with a diameter corresponding to a diameter of the support leg. The first receiving groove 514 may have a larger diameter than that of the cutout portion 513.

An inner surface of the first extension 511 provided to face the inside of the upper surface of the second cabinet 301 and an inner surface of the second extension 521 provided to face the inner surface of the upper surface of the second cabinet 301 may be extended to each other and may be extended to each other in a quarter circular shape or a curved shape.

Accordingly, it is possible to secure a sufficient area of the support plate 510 while arranging the cutout portion 513 or the first receiving groove 514 in the support plate 510, and also to radially disperse vibration transmitted to the support plate 510.

Meanwhile, the rib 520 may further include a third rib 523 extending upward and protruding from the inner surface of the first extension 511 and the inner surface of the second extension 512. The third rib 523 may be spaced apart from the first rib 521 and the second rib 522 and may be in a shape protruding upward from a portion of an outer circumferential surface of the support plate 510.

The first rib 521 and the second rib 522 may be defined to extend from the exposed surface of the support plate 510, and the third rib 523 may be defined to extend from a shielded surface in which the support plate 510 is not exposed.

The third rib 523 may be provided to disperse and dissipate vibration transmitted to the support plate 510 at various angles.

A thickness of the third rib 523 may be smaller than a thickness of the first rib 521 and a thickness of the second rib 522, or a height of the third rib 523 may be smaller than a height of the first rib 521 and a height of the second rib 522. This is because that the third rib 523 is located inside the second cabinet 301 further than the first rib 521 and the second rib 522, an amplitude of vibration transmitted to the inside of the second cabinet 301 may be smaller than an amplitude of vibration transmitted to the outside of the second cabinet 301.

The first bracket 501 may include a ridge 530 protruding from the inner surface of the support plate. In the support plate 510, the ridge 530 may reinforce the rigidity of the support plate 510 or dissipate vibration transmitted to the support plate. The ridge 530 may extend along the third rib 523 and protrude upward from the support plate 510. Thus, the ridge 530 may disperse vibration in multiple directions transmitted to the support plate 510, and may disperse the vibration together with the third rib 523. In addition, the ridge 530 may reinforce the rigidity of the support plate 510 itself.

When the first cabinet 201 has a large capacity, the placement of the support legs 210 may vary. Thus, a space in which the support leg 210 is disposed may be formed outside the cutout portion 513. Depending on the placement of the support leg 210, a position at which the cutout portion 513 is provided in the support plate 510 may be determined, and a position at which the support plate 510 is installed on the upper surface of the second cabinet 301 may be determined.

The bracket 500 may further include a second bracket 502 having a structure different from that of the first bracket 501. The second bracket 502 may have the same basic structure as that of the first bracket 501. Thus, the second bracket 502 will be described mainly about a structure different from that of the first bracket 501.

The second bracket 502 may include a support plate 510 and ribs 520, as does the first bracket 501. The second bracket 502 may further include a second receiving groove 515 spaced apart from the cutout portion 513 and penetrating the support plate 510 to fully accommodate any one of the plurality of support legs 210.

That is, the second bracket 502 may completely accommodate the support leg 210, thereby preventing the support leg 210 from being deviated from the support plate 510, and may receive vibration transmitted in all directions from the support leg 210.

In addition, the cutout portion 513 spaced apart from the second receiving groove 515 may also be provided in a shape capable of receiving or supporting a portion of the outer circumferential surface of the support leg 210. Accordingly, even the first cabinet 201 having the support legs 210 diagonally spaced apart from the second receiving groove 515 may also be stably supported by the second bracket 502.

Meanwhile, due to the second receiving groove 515, the ridge 530 may be omitted, but the third rib 523 may be provided.

Meanwhile, the first extension 511 and the second extension 512 may have different lengths, and the first rib 521 and the second rib 522 may also have different lengths.

For example, depending on the position where the second receiving groove 515 is spaced apart from the cutout portion 513, any one of the first extensions 511 may be provided to be longer than the second extension 512. That is, when the second receiving groove 515 is provided close to the first extension 511, a greater vibration may be transmitted to the first extension 511. Thus, the first extension 511 may be provided to be longer than the second extension 512, and the first rib 521 may be provided to be longer than the second rib 522.

Meanwhile, since the second receiving groove 515 is able to support vibration more strongly than the first receiving groove 514, the first bracket 501 and the second bracket 502 may be provided separately in the front or rear, as shown in FIG. 3.

However, only the first bracket 501 or only the second bracket 502 may be provided in the second cabinet 301, and the first bracket 501 and the second bracket 502 may be provided alternately in a diagonal direction.

Meanwhile, referring to FIG. 3, the first receiving groove 514 or the second receiving groove 515 may be provided in a shape in which an edge protrudes. The first receiving groove 514 or the second receiving groove 515 may include a rim protruding upward from the support plate 510 to support the side surfaces of the plurality of support legs 210. The rim may be provided in a shape to protrude upward from the support plate 510.

A height of the rim may be defined as a height at which the rim protrudes upward from the support plate 510. The height of the rim may be the same as that of any one of the first rib 521, the second rib 522, and the third rib 523. Meanwhile, the height of the rim may be lower than a height of the first rib 521, the second rib 522, and the third rib 523.

Accordingly, a part or all of the outer circumferential surface of the support leg 210 may be stably accommodated in the first receiving groove 514 or the second receiving groove 515, and the support legs 210 may be stably supported by the first receiving groove 514 or the second receiving groove 515.

FIG. 4 is a view showing a coupled structure between a bracket and a cabinet of a laundry treating apparatus according to the present disclosure.

In the second cabinet 301, a configuration such as a rail 360 to pull out the drawer 301*a* may be provided inside. The rail 360 may include a coupling rib 3611 fixed to the rail coupling portion 3211, a fixed rail 361 fixed to the coupling rib 3611, and a pull-out rail 362 coupled to both side surfaces of the drawer 301*a* so as to be pulled out from the fixed rail 361 toward an opening formed by the pull-out frame 310.

A lower end of the side panel 321 may be bent inwardly to reinforce the rigidity of the side panel 321.

Meanwhile, the second treatment unit 200 may include a second support leg 370 provided to support a load of the second cabinet 201. The second support leg 370 may be coupled to both ends of the side panel 321, and may be coupled and fixed to both ends of the fixed rail 361.

Meanwhile, the second support leg 370 may include a support damper 380 for buffering an impact transmitted to the second support leg 370. Accordingly, it is possible to absorb the impact that can be transmitted to the ground, thereby preventing propagation of noise. Since the first cabinet 201 is provided of a front-load type and the first driving part 204 is located at a rear surface, the support damper 380 may be installed only in a second support leg 370 located at the rear surface of the main body 320. Accordingly, it is possible to intensively buffer an impact in an area where a vibration occurs.

The fixing frame 330 may be disposed at the rear surface of the main body 320. The fixed frame 330 may be provided in the form of a frame having a C-shaped cross-section. Accordingly, it is possible to secure greater rigidity than that of the main body 320, and to support a load of the first cabinet 201 with the upper surface of the fixed frame 330 or both sides of the upper surface of the fixed frame. The fixed frame 330 may be provided such that only a portion facing the main body 320 is opened and one surface away from the main body 320 is completely shielded.

Accordingly, the fixing frame 330 may form a rear surface of the second cabinet 201 and the inside of the second cabinet 201 may be prevented from being exposed at the rear surface.

The second cabinet 301 may further include a lower panel disposed under the main body 320 to shield the bottom of the cabinet. With the lower panel, the second driving part 304 or the drawer 301*a* may be prevented from being exposed at the bottom, and the rigidity and shape of the side panel 321 of the main body 320 may be maintained.

Meanwhile, the lower panel may include a panel body disposed under the main body 320, and an open hole for exposing the second driving part 304 or discharging heat generated in the second driving part 304.

Accordingly, it is possible to prevent overheating of the second driving part 304, and to simply repair or installation of the second driving part 304.

The pull-out frame 310 and the fixed frame 330 may be accommodated in the main body 320 to support the main body 320 or maintain the shape of the main body 320.

The pull-out frame 310 may include a support frame 311 disposed at both front sides of the main body 320, a main frame 312 provided to connect upper ends of the support frames 311 provided on both sides, and an extension frame 314 coupled to lower ends of the support frames 311 to form an opening or a closed curve through which the drawer 301*a* is pulled out.

Meanwhile, the drawer 301*a* is provided to be pulled out from the pull-out frame 310 through the support frame 311, the main frame 312, and an opening formed by the extension frame 314.

In this case, since the lower portion of the main body 320 is open and the fixed frame 330 is shielded, a height of the drawer 301*a* is determined to be a height of the opening of the pull-out frame 310.

In addition, since the lower portion of the second cabinet 302 is spaced apart by a predetermined distance due to the second support leg 370, there is an enough space where the pull-out frame 310 is able to further expend downwardly. Thus, the extension frame 314 may be bent further downward than the lower end of the support frame 311, so that the opening can further expand downwardly.

As a result, a volume of the drawer 301*a* may expand, and when the bottom of the drawer 301*a* is opened so that the second driving part 304 protrudes, interference with the second driving part 304 may also be avoided.

Accordingly, as the internal volume of the drawer 301*a* is expanded, a larger washing capacity and the larger structure of a balancer and suspension part attached to an upper portion of the drum may be installed.

However, when the support frame 311 and the extension frame 314 are integrally provided, bending the bottom of the drum 301*a* downwardly by deforming the extension frame 314 cannot overcome the plastic deformation of the material and thus a rate of expansion may be limited.

Therefore, the increased washing capacity may not be sufficient, and there may be insufficient space for a balancer and a suspension structure to be installed.

Accordingly, in the laundry treating apparatus 100 according to an embodiment of the present disclosure, the extension frame 314 may be provided separately from the support frame 311 and the extension frame 314 may be further bent downward.

The extension frame 314 may be of a material having a greater degree of plastic deformation than that the support frame 311 so as to be bent further wider and downward. Thus, the opening of the pull-out frame 310 may be further expanded, and accordingly, a height of the drawer 301*a* to be pulled out may be further expanded.

Therefore, the height of the second tub 302 may be higher, and accordingly, a larger balancer to be coupled to the top of the second drum 303 may be installed or a larger installation space of the second suspension 307 may be secured, so that a complex structure can be sufficiently installed.

Meanwhile, at the front of the pull-out frame 310 or the main body 320, a sensor s for detecting whether the drawer 301*a* is pulled out or whether the second door for opening and closing a loading port of the second tub 302 is opened or closed may be installed.

Meanwhile, in the second cabinet 301, a frame support part 600 for guiding the pull-out frame 310 and the fixed frame 330 to be coupled to the main body 320 may be further installed.

The frame support part 600 may be provided at each edge of the main body 320 so as to provide a structure coupled to the pull-out frame 310 and the fixed frame 330, and may provide a structure in which the bracket 500 supporting the support leg 210 of the first cabinet 201 is also coupled.

The bracket 500 may be coupled to the pull-out frame 310 or the fixed frame 330 through the frame support part 600.

Meanwhile, when the frame support part 600 is not included in the second cabinet 301, the bracket 500 may be coupled to one side of the pull-out frame 310 or the fixed frame 330 by a fastening member.

The frame support part 600 may include a placement body 630 placed at the side panel 321, an attachment body 610 provided on the placement body 630 and attached to the upper panel 322, and a connection body 620 extending from one end of the attachment body and coupled to the fixed frame 330 or the pull-out frame 310.

The placement body 630 may have a recessed surface recessed inwardly from a surface of the placement body, thereby reinforcing its own rigidity and ensuring seismic resistance.

The connection body 620 may be provided with a connection hole 621 through which a fastening member can pass to be coupled. As being coupled to one of the fixing frame 330 or the pull-out frame 310, the fastening member or the like may be coupled to the main body 320 and the connection body 620.

On an upper surface of the attachment body 610, an attachment hole 611 through which a fastening member passing through the bracket 500 is coupled may be provided, and an exposure hole 612 through which a configuration such as a switch sensing part may be exposed.

The attachment hole 611 may be provided in plural on the attachment body 610, and a plurality of attachment holes 611 may be disposed to be spaced apart from each other. Accordingly, the fastening member passing through the bracket 500 may also be coupled to the attachment hole 611, so that the bracket 500 is firmly fixed to the upper portion of the second cabinet 301 and the pull-out frame 310 or the fixed frame 330 of the second cabinet 301.

The bracket 500 may further include a plurality of support holes penetrating through the support plate 510 to which the fastening member can be coupled. A part of the support hole may be disposed in an area corresponding to the attachment hole 611, and the rest thereof may be disposed along a longitudinal direction of the first extension plate 511 and the second extension plate 512.

Meanwhile, the frame support part 600 may allow the main body 320 and the fixed frame 330 or the pull-out frame 310 to be coupled to each other through three sides of the placement body 630, the attachment body 610, and the connection body 620.

In addition, the frame support 600 may be attached to each area corresponding to a vertex of the upper panel 322, thereby reinforcing the rigidity of the main body 320.

Unlike the above description, the pull-out frame 310 and the fixed frame 330 may be provided outside the main body 320 and coupled to the main body 320.

Figure 5:
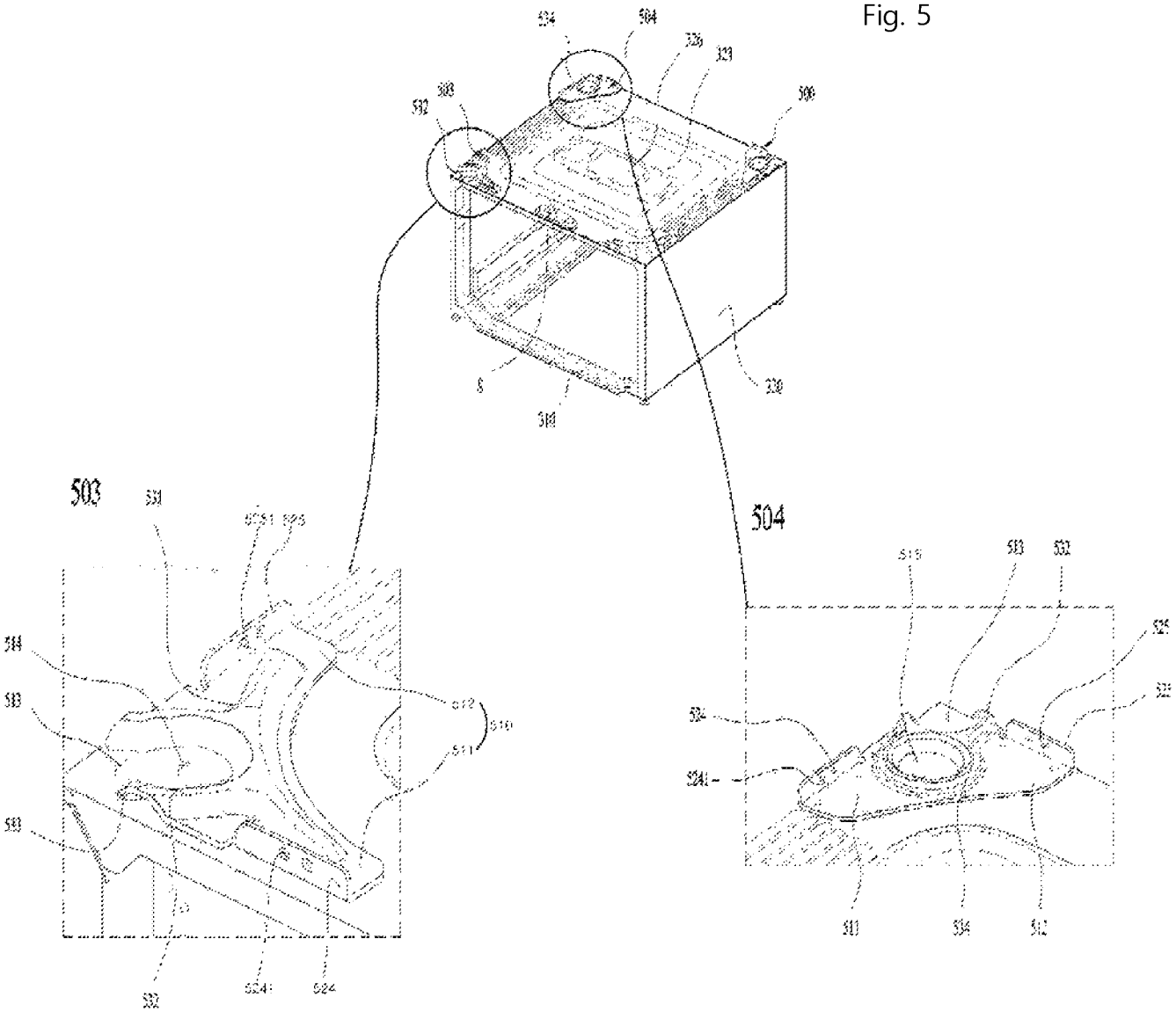
FIG. 5 is a view showing a bracket of a laundry treating apparatus according to an embodiment of the present disclosure.

FIG. 5 shows an additional example of the bracket 500 of the laundry treating apparatus 100 according to an embodiment of the present disclosure.

Referring to FIG. 5, the bracket 500 of the laundry treating apparatus of the present disclosure may include a third bracket 503.

The third bracket 503 may have the same basic structure as that of the first bracket 501.

The third bracket 503 may include a support plate 510 as does the first bracket 501. The support plate 510 may include a first extension 511 extending along a first edge of the second cabinet 301, and a second extension 512 extending along a second edge adjacent to the first edge in the first extension 511.

The third bracket 503 may further include a cutout portion 513 separating the exposed surface of the first extension 511 and the exposed surface of the second extension 512.

The cutout portion 513 may be provided in a shape that is recessed inwardly of the support plate from a vertex where the first edge and the second edge intersect.

The third bracket 503 may include the rib 520.

The rib 520 may include a fourth rib 524 bent at a portion of an exposed surface of the first extension 511 and spaced apart from the cutout portion 513, and a fifth rib 525 bent at a portion an exposed surface of the second extension 512 and spaced apart from the cutout portion 513.

Unlike the first rib 521, the fourth rib 524 may not extend along the entire exposed surface of the first extension 511. In addition, unlike the second rib 522, the fifth rib 525 may not extend along the entire exposed surface of the second extension 512.

The fourth rib 524 may only partially extend along the exposed surface at a distal end of the first extension 511, and the fifth rib 525 may only partially extend along the exposed surface from a distal end of the second extension 512.

Since a vibration transmitted to the support leg 210 in the vicinity of the cutout portion 513 can be amplified toward the distal ends of the first extension 511 and the second extension 512, the fourth rib 524 and the fifth rib 525 may be concentratedly disposed at the distal ends of the first extension 511 and the second extension 512 to dissipate the vibration transmitted to the first extension 511 and the second extension 512.

In addition, at least one of the fourth rib 524 and the fifth rib 525 may include at least one through-hole 5241 and 5251.

The third bracket 503 may include at least one of a first through-hole 5241 penetrating through the fourth rib 524 and a second through-hole 5251 penetrating through the fifth rib 525.

Accordingly, the fourth rib 524 and the fifth rib 525 may dissipate a concentrated vibration, and the rigidity of the fourth rib 524 and the fifth rib 525 may be maintained. The first through-hole 5241 and the second through-hole 5251 may be fixed by fastening a fastening member that is coupled to a configuration related to the first cabinet 201.

The third bracket 503 may include a cutout projection 533 protruding from an outer circumferential surface of the cutout portion 513 and spaced apart from the fourth rib 524 and the fifth rib 525.

The cutout projection 533 may be formed in an area where the fourth rib 524 and the fifth rib 525 do not extend on the exposed surface of the first extension 511 and the exposed surface of the second extension 512.

The cutout projection 533 may be provided by bending the support plate 510 so that an outer circumferential surface of the cutout portion 513 protrudes to be thicker. Due to the cutout projection 533, a vibration transmitted to both ends or an inner circumferential surface of the cutout 514 may be dispersed to the cutout projection 533, without being concentrated to the inner circumferential or both ends of the cutout portion 513.

Meanwhile, the cutout projection 533 may have a predetermined height or thickness to prevent the support leg 210 from being separated from the cutout portion 513.

The third bracket 503 may include a first receiving groove 514 provided to extend from the cutout to support any one of a plurality of support legs 210. The first receiving groove 514 may have a diameter equal to or greater than that of the cutout portion 513.

The third bracket 503 may further include a receiving projection 532 protruding along an outer circumferential surface of the first receiving groove 514.

That is, the receiving projection 532 may be provided by being bent upward from the first receiving groove 514, and may be provided such that an area of the support plate 514 corresponding to the outer circumferential surface of the first accommodating groove 514 is bent upward.

The receiving projection 532 may extend from the cutout projection 533, and the cutout projection 533 and the receiving projection 532 may be simultaneously formed or processed.

The receiving projection 532 may stably receive a support leg 210 seated in the first receiving groove 514, and may disperse along the outer circumferential surface of the support leg 210 a vibration transmitted from the support leg 210 or a vibration transmitted to the support leg 210.

Meanwhile, the receiving projection 532 may be provided at the outer circumferential surface of the first receiving groove 514 and spaced apart from the fourth rib 524 and the fifth rib 525.

Thus, it is possible to prevent the fourth rib 524 and the fifth rib 525 from interfering with the receiving projection 532.

The third bracket 503 may further include a ridge 531 spaced apart from the inner surface of the support plate 510 and protruding along the inner surface of the support plate. The ridge 531 may be provided along the inner surface of the support plate 510, and may be provided along the shape of the support plate 510.

The ridge 531 may protrude from the support plate 510, and may be manufactured by pressing the support plate 510.

The ridge 531 may support the support plate 510 by dispersing multidirectional vibrations transmitted to the support plate 510. Thus, durability of the support plate 510 may be enhanced due to the ridge 531.

The third rib may be omitted due to the ridge 531. Thus, an additional process of manufacturing the third rib may be omitted.

At least two or more of the cutout projection 533, the receiving projection 532, and the ridge 531 may be formed integrally with each other, and all of the cutout projection 533, the receiving projection 532, and the ridge 531 may be formed integrally with each other. The cutout projection 533, the receiving projection 532, and the ridge 531 may protrude from the support plate 510 to have a width that becomes narrower in a direction away from the support plate 510, and the cutout projection 533, the receiving projection 532, and the ridge 531 may have the same height.

Meanwhile, the bracket 500 of the laundry treating apparatus 100 may further include a fourth bracket 504.

The fourth bracket 504 may have the same basic structure as that of the second bracket 502.

In addition, the fourth bracket 504 may include a cutout portion 513, a fourth rib 524, and a fifth rib 525, as does the third bracket 503.

The fourth bracket 504 may further include a second receiving groove 515 spaced apart from the cutout portion 513 and penetrating the support plate 510 to receive any one of the plurality of support legs 210, and may be provided with a protruding ring 534 protruding along an outer circumferential surface of the second receiving groove 515.

The protruding ring 534 may be spaced apart from the fourth rib 524 and the fifth rib 525.

The protruding ring 534 may protrude from the support plate 510, and may completely receive the support leg 210. Accordingly, it is possible to primarily disperse and support a vibration transmitted from the support leg 210.

The protruding ring 534 may reinforce the rigidity of the support plate 510, and may disperse multidirectional vibrations transmitted from the support leg 210 or multidirectional vibrations transmitted to the support plate 510. Thus, the configuration of the ridge 531 or the third rib 523 may be omitted.

Meanwhile, the cutout projection 532 may be provided on the outer circumferential surface of the cutout portion 513, and the cutout projection 532 may be provided to extend with the protruding ring 534. The cutout portion 513 may accommodate a portion of the outer circumferential surface of the support leg 210, and the cutout projection 532 may protrude along a portion of an outer circumferential surface of the support leg 210.

Thus, the cutout projection 532 may support a vibration transmitted from the support leg 210 by dispersing the vibration in multi-directions or in a radial direction.

The cutout projection 532 and the protruding ring 534 may protrude from the support plate 510 to have a width that becomes narrower in a direction away from the support plate 510, and the cutout projection 532 and the protruding ring 534 may have the same height. The cutout projection 532 and the protruding ring 534 may be formed integrally with each other.

FIG. 5 shows that the third bracket 503 is provided at the front and the fourth bracket 504 is provided at the rear. Accordingly, a rear support leg 210 may be completely received in the fourth bracket 504, and a front support leg 210 may be supported by the third bracket 503.

Thus, it is possible to more reliably disperse and support a vibration transmitted to the rear of the second cabinet 301, and to relatively easily install the support legs 210 supported at the front of the second cabinet 301.

However, this is merely an example, and only the third bracket 503 may be provided in an upper surface of the second cabinet 301, only the fourth bracket 504 may be provided, and the third bracket 503 and the fourth bracket 504 may be installed to face each other in a diagonal direction.

Meanwhile, the bracket 500 may be of a metal material, but even if made of a non-metal material, the bracket 500 may be provided in the above-described shape to ensure rigidity while dispersing and dissipating a vibration.

Certain embodiments or other embodiments of the disclosure described above are not mutually exclusive or distinct from each other. Any or all elements of the embodiments of the disclosure described above may be combined with another or combined with each other in configuration or function).

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a first cabinet;

a first accommodating part disposed in the first cabinet, the first accommodating part being configured to accommodate laundry;

a second cabinet disposed below the first cabinet;

a second accommodating part disposed in the second cabinet and configured to accommodate laundry;

a support part extending from a lower portion of the first cabinet to support the first cabinet; and a bracket disposed on the second cabinet to support the support part, the bracket including:

a support plate in contact with an upper surface of the second cabinet to support the first cabinet; and a rib protruding upward from at least a portion of an outer rim of the support plate, whereinthe rib has a cantilever shape such that an upper end of the rib is unsupported.

2. The laundry treating apparatus of claim 1, wherein the rib comprises:

a first rib protruding upward from the support plate along a first edge of a corresponding corner of the upper surface of the second cabinet;

a second rib protruding upward from the support plate along a second edge adjacent to the first edge of the corresponding corner of the upper surface of the second cabinet; and a third rib spaced apart from the first rib and the second rib, the third rib protruding upward from a portion of the outer rim of the support plate.

3. The laundry treating apparatus of claim 2, wherein the bracket further comprises a ridge protruding upward from an inner surface of the support plate, and wherein the ridge extends in a direction in which the third rib extends along the outer rim of the support plate.

4. The laundry treating apparatus of claim 2, wherein the bracket further includes a cutout recessed inwardly from a vertex of the support plate where a first edge and a second edge of the support plate would intersect, the cutout being open toward the corresponding corner of the upper surface of the second cabinet, and wherein the cutout separates the first rib and the second rib.

5. The laundry treating apparatus of claim 4, wherein at least one of the first rib and the second rib comprises at least one through-hole.

6. The laundry treating apparatus of claim 4, wherein the bracket further comprises a receiving groove configured to support the support part.

7. The laundry treating apparatus of claim 6, wherein the receiving groove has a shape extending from the cutout, the receiving groove being recessed inwardly of the support plate from the cutout.

8. The laundry treating apparatus of claim 7, wherein the receiving groove comprises an edge protruding upward from the support plate, the edge being configured to support a side surface of the support part.

9. The laundry treating apparatus of claim 6, wherein the receiving groove is circular, the receiving groove being spaced from the cutout.

10. The laundry treating apparatus of claim 9, wherein the receiving groove comprises an edge protruding upward from the support plate, the edge being configured to support a side surface of the support part.

11. The laundry treating apparatus of claim 1, wherein the second cabinet comprises:

a main body; and a frame supporting the main body at a front and a rear of the main body, and wherein the bracket is coupled to the frame.

12. The laundry treating apparatus of claim 11, further comprising a frame support part, the bracket being coupled through the frame to the frame support part.

13. The laundry treating apparatus of claim 1, further comprising a driver provided rearward in the first cabinet, the driver being configured to rotate the first accommodating part, wherein the bracket includes a front bracket disposed at a front of the upper surface of the second cabinet and a rear bracket disposed at a rear of the upper surface of the second cabinet, and wherein the front bracket is made of a metal material.

14. The laundry treating apparatus of claim 13, wherein the rear bracket is made of plastic.

15. A laundry treating apparatus comprising:

a first cabinet;

a first accommodating part disposed in the first cabinet, the first accommodating part being configured to accommodate laundry;

a second cabinet disposed below the first cabinet, the second cabinet including:

a main body; and a frame supporting the main body at a front and a rear of the main body;

a second accommodating part disposed in the second cabinet and configured to accommodate laundry;

a support part extending from a lower portion of the first cabinet to support the first cabinet;

a bracket disposed on the second cabinet to support the support part, the bracket including:

a support plate in contact with an upper surface of the second cabinet to support the first cabinet; and a rib protruding upward from at least a portion of an outer rim of the support plate; and a frame support part, the bracket being coupled through the frame to the frame support part, wherein the rib has a cantilever shape such that an upper end of the rib is unsupported.

16. The laundry treating apparatus of claim 15, wherein the rib comprises:

a first rib protruding upward from the support plate along a first edge of a corresponding corner of the upper surface of the second cabinet;

a second rib protruding upward from the support plate along a second edge adjacent to the first edge of the corresponding corner of the upper surface of the second cabinet; and a third rib spaced apart from the first rib and the second rib, the third rib protruding upward from a portion of the outer rim of the support plate.

17. The laundry treating apparatus of claim 16, wherein the bracket further comprises a ridge protruding upward from an inner surface of the support plate, and wherein the ridge extends in a direction in which the third rib extends along the outer rim of the support plate.

18. The laundry treating apparatus of claim 16, wherein the support plate includes a cutout recessed inwardly from a vertex of the support plate where a first edge and a second edge of the support plate would intersect each other, the cutout being open toward the corresponding corner of the upper surface of the second cabinet.

19. The laundry treating apparatus of claim 18, wherein the cutout separates the first rib and the second rib.

20. The laundry treating apparatus of claim 16, wherein the bracket further comprises a receiving groove configured to support the support part.

* * * * *